US009797419B2

(12) United States Patent
Rantanen

(10) Patent No.: US 9,797,419 B2
(45) Date of Patent: Oct. 24, 2017

(54) HYDRAULIC SYSTEM WITH ENERGY RECOVERY

(71) Applicant: PARKER HANNIFIN MANUFACTURING FINLAND OY, Urjala (FI)

(72) Inventor: Jari Rantanen, Viiala (FI)

(73) Assignee: PARKER HANNIFIN MANUFACTURING FINALND OY, Urjala (FI)

( * ) Notice: Subject to any disclaimer, the term of this patent is extended or adjusted under 35 U.S.C. 154(b) by 371 days.

(21) Appl. No.: 14/735,829

(22) Filed: Jun. 10, 2015

(65) Prior Publication Data

US 2015/0361998 A1 Dec. 17, 2015

(30) Foreign Application Priority Data

Jun. 13, 2014 (EP) ..... 14397522

(51) Int. Cl.

| | |
|---|---|
| ***F15B 11/08*** | (2006.01) |
| ***F15B 21/14*** | (2006.01) |
| ***E02F 9/22*** | (2006.01) |

(52) U.S. Cl.

CPC ..... *F15B 21/14* (2013.01); *E02F 9/2217* (2013.01); *E02F 9/2228* (2013.01); *E02F 9/2235* (2013.01); *E02F 9/2296* (2013.01); *F15B 2211/20546* (2013.01); *F15B 2211/20569* (2013.01); *F15B 2211/3055* (2013.01); *F15B 2211/3058* (2013.01); *F15B 2211/30535* (2013.01); *F15B 2211/40569* (2013.01); *F15B 2211/415* (2013.01); *F15B 2211/41509* (2013.01); *F15B 2211/465* (2013.01); *F15B 2211/50563* (2013.01); *F15B 2211/515* (2013.01); *F15B 2211/5151* (2013.01); *F15B 2211/7052* (2013.01);

(Continued)

(58) Field of Classification Search

CPC ..... F15B 21/14; F15B 11/024; E02F 9/2217
USPC ..... 91/450, 451
See application file for complete search history.

(56) References Cited

U.S. PATENT DOCUMENTS

| | | | | |
|---|---|---|---|---|
| 2003/0221339 | A1 | 12/2003 | Naruse et al. | |
| 2007/0166168 | A1 | 7/2007 | Vigholm et al. | |
| 2013/0098023 | A1* | 4/2013 | Yoshino | E02F 9/2217 60/413 |

FOREIGN PATENT DOCUMENTS

| | | | |
|---|---|---|---|
| DE | 102006060351 | B3 | 4/2008 |
| DE | 102008038992 | A1 | 2/2010 |
| WO | 2010/138029 | A1 | 12/2010 |

* cited by examiner

*Primary Examiner* — Michael Leslie
*Assistant Examiner* — Daniel Collins
(74) *Attorney, Agent, or Firm* — Oliff PLC

(57) ABSTRACT

A hydraulic system for recovering hydraulic energy, the hydraulic system made of at least: a first actuator for generating hydraulic energy and providing fluid under pressure; a tank line for receiving the fluid under pressure drained from the first actuator; a second actuator driven by the fluid under pressure drained from the first actuator; a recovery line for supplying the fluid under pressure drained from the first actuator. The system further includes a pressure compensating valve which controls flow of fluid in the tank line and maintains a fluid pressure differential across a first directional control valve. The first pressure compensating valve is provided with a first fluid pressure sensing line in communication with the recovery line and a second fluid pressure sensing line in communication with the first actuator.

19 Claims, 7 Drawing Sheets

(52) U.S. Cl.
CPC ..... *F15B 2211/7053* (2013.01); *F15B 2211/7058* (2013.01); *F15B 2211/7121* (2013.01); *F15B 2211/7135* (2013.01); *F15B 2211/88* (2013.01)

HYDRAULIC SYSTEM WITH ENERGY RECOVERY

TECHNICAL FIELD

The presented solution relates to a hydraulic system for recovering hydraulic energy.

BACKGROUND

Construction, forestry and agricultural equipment and mobile working machines have movable members which are operated by an actuator, such as a motor or a hydraulic cylinder with a moving piston rod. The movable members are e.g. boom parts rotatably connected to each other in a boom crane. The boom cranes are used for handling loads or controlling a tool connected to an end of a boom part of the boom crane. Pressurized hydraulic fluid from a pump to the actuator can be controlled by a set of valves. When an operator desires to move a movable member, a control lever is operated to send signals to the valves for the cylinder associated with that movable member. The valve is opened to supply pressurized fluid to a chamber of the cylinder on one side of the piston and to allow fluid forced from the opposite chamber of the cylinder to drain to a reservoir or a tank. By varying the degree to which the valve is opened, the rate of flow into the actuator or the associated chamber can be varied, thereby moving the piston rod and the movable member at different speeds.

Hydraulic systems waste hydraulic energy (i.e. potential energy) by lowering loads using pressurized fluid, valves generating pressure losses and pumps generating hydraulic energy and fluid flow while lowering the loads. However, potential energy produced in an actuator of a hydraulic system by the loads may be used to operate another simultaneous actuator function.

SUMMARY

A solution is presented relating to recovering potential energy produced in a hydraulic system by loads, e.g. when a load acts on an actuator. An example is a boom crane lowering a load but the presented solution is applicable to other applications also. The recovered energy in the form of pressurized fluid is used to drive another simultaneous actuator function or several simultaneous actuator functions. The actuator function is driven with the help of the recovered energy solely or simultaneously with the hydraulic energy generated by a pressure source of the hydraulic system, e.g. a pump. The recovered energy is supplied by one actuator or several actuators.

According to the solution, the hydraulic system directs the fluid forced from an actuator, e.g. a chamber of a hydraulic cylinder, to assist in driving another actuator, e.g. a chamber of another hydraulic cylinder, rather than routing the fluid to a tank. Typically, the fluid is drained from an actuator being not driven by a pump but by a lowering load. The actuator may be a hydraulic cylinder, a hydraulic motor or a hydraulic pump-motor. Recycling the pressurized fluid is referred to as regeneration or recovery.

DESCRIPTION OF EXAMPLE EMBODIMENTS

Figure 1:
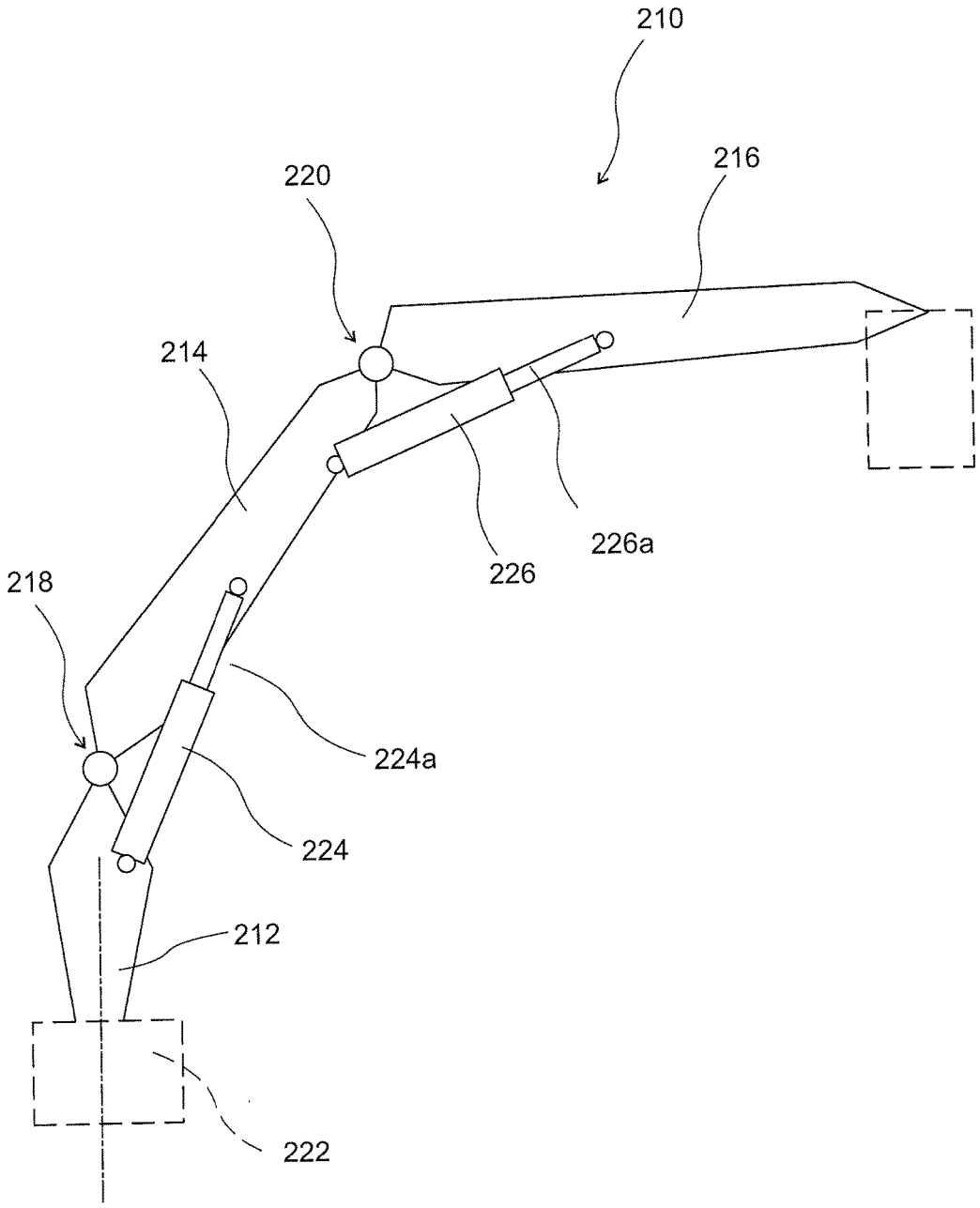
FIG. 1 shows an exemplary boom crane applying the presented solution.

An example of movable members controlled by the hydraulic system according to the solution is shown in FIG. 1. The movable members relate to a boom crane 210.

The boom crane 210 can be turned in lateral directions, and it typically comprises two or more arms or boom parts 214 and 216 moving in a vertical plane and which are connected to each other by means of a joint 220. In the example of FIG. 1, the boom part 214 is connected by means of a joint 218 to a base 212 providing swiveling movements. The base 212 may be a part of a chassis of a working machine. Alternatively, the base 212 is connected to the chassis by means of a swiveling device 222 providing turning in the lateral directions. The positions of the boom crane 210 and its boom parts are controlled by actuators to generate hoisting and lowering movements of an implement or a tool connected to the end of the outermost boom part 216. Typically, the actuator is a hydraulic cylinder utilizing hydraulic energy which is transmitted to the actuator by means of lines, i.e. hydraulic transmission lines. A hydraulic system is needed for generating the hydraulic energy and it is placed e.g. in the chassis or on the boom crane. Typically, one boom part is telescopically operating, for example the outermost boom part 216.

A cylinder 224 is connected between the base 212 and the boom part 214 for lifting and lowering the boom part 214. A cylinder 226 is connected between the boom part 214 and the boom part 216 for lifting and lowering the boom part 216. Recyclable potential energy is generated in a chamber of the cylinder 224 when lowering the boom part 214 with the help of the weight of both a load and the boom parts 214 and 216. According to another example, potential energy is generated in a chamber of the cylinder 226 when lowering the boom part 216 with the help of the weight of both the load and the boom part 216.

In the example of FIG. 1, the piston rod 224*a* of the cylinder 224 is connected to the boom part 214 for controlling the boom part 214 and hydraulic energy is generated in the bottom chamber of the cylinder 224.

Figure 2:
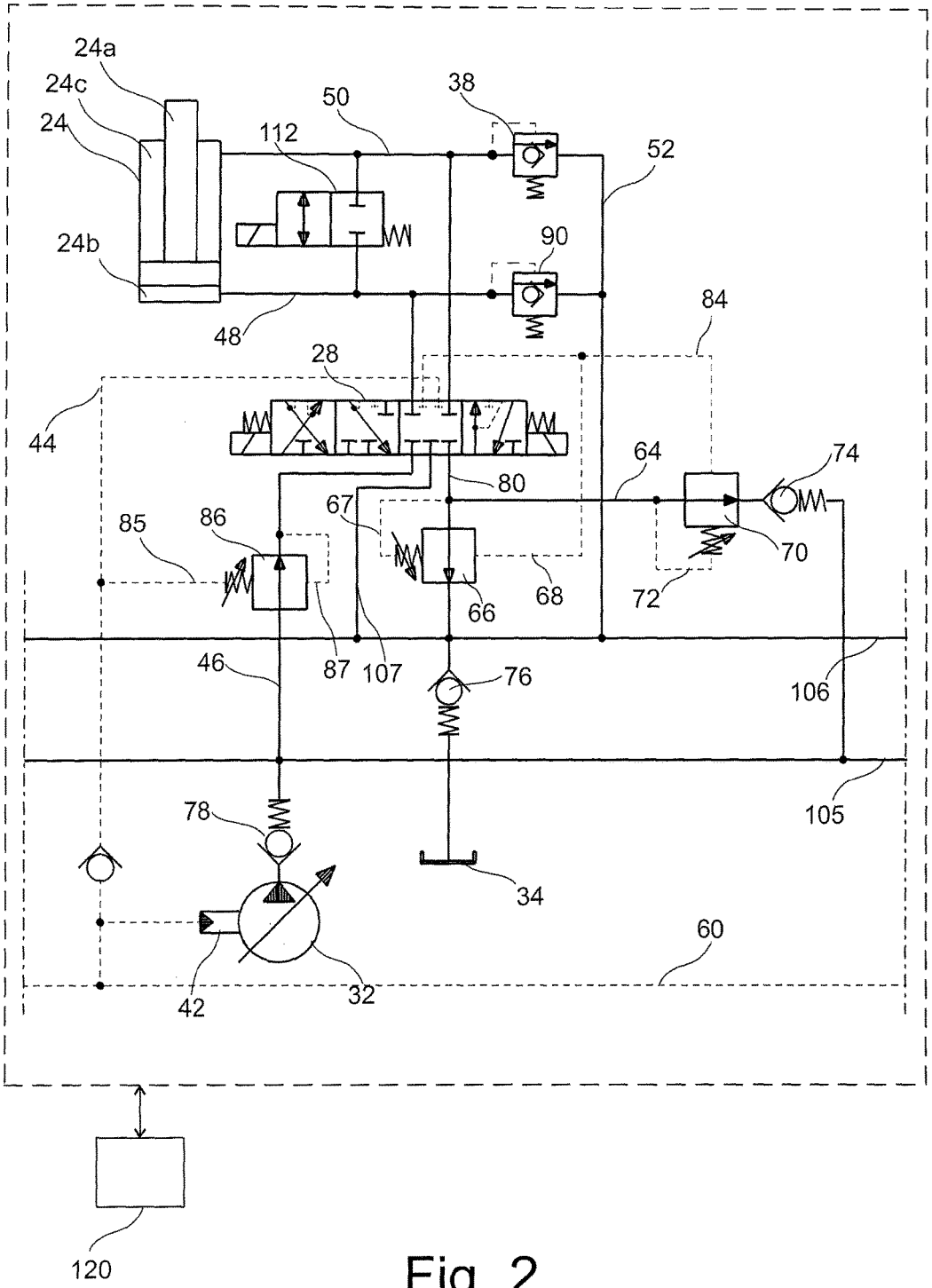
FIG. 2 and FIG. 3 show subsystems relating to an exemplary embodiment of the hydraulic system applying the presented solution.
Figure 3:
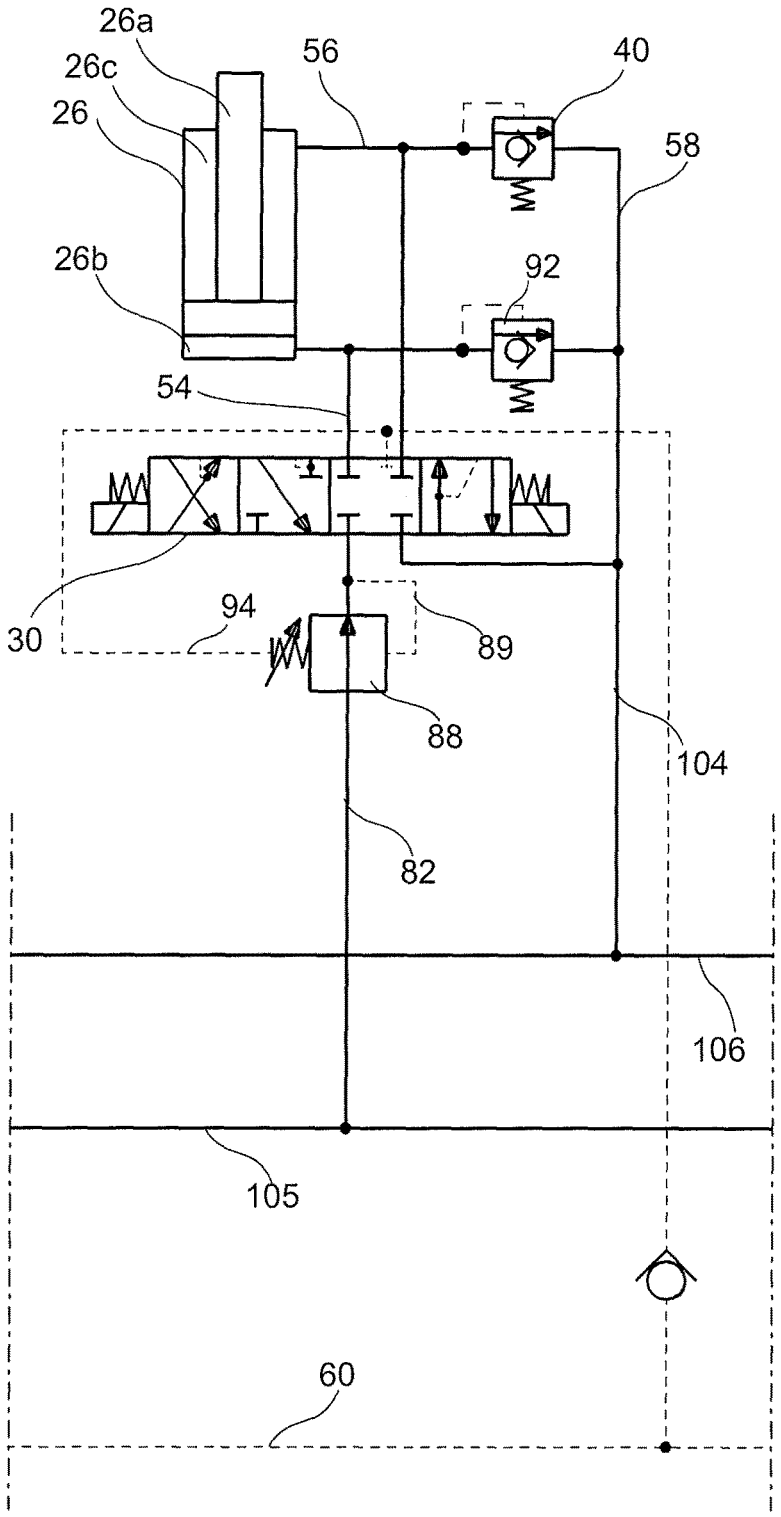

The presented solution can be utilized to control the actuators in FIG. 1 and is represented by an exemplary hydraulic system shown in FIGS. 2 and 3. In the subsystems of FIGS. 2 and 3 the actuators in use are double acting hydraulic cylinders.

The system represented by the subsystems of FIGS. 2 and 3 includes a hydraulic circuit for recovering hydraulic energy. The components necessary for the hydraulic circuit are as explained in the following description. Other components for good controllability of the system, subsystems and the hydraulic circuit are as explained in the following description. Various combinations of the presented components may be used for realizing the system, the subsystems or the hydraulic circuit based on different needs and applications.

Hydraulic transmission lines between various components of the system are designated by solid lines, and pressure sensing hydraulic transmission lines are designated by dashed lines. The figures show one example to create connections between the lines and the various components of the presented system. Other examples or alternatives are mentioned in this description.

A line may have branches for allowing various components to be connected to the line or to isolate a section of the line from another section of the line. Two lines may be connected to each other at several alternative locations or at a component such that the lines are in communication with each other so that flow of fluid is made possible. Various components may be in communication with each other via lines between the components. The line may be a hose, a pipe or a channel, or a combination of the same. The channel may be located in e.g. a block-like element connecting two separate components or several components. In the presented solution, a line may be connected to another line at a location at the end of the other line or along the other line, or, at a location where the line is connected to a component, e.g. a valve.

Various components of the system may receive electronic control signals from a system controller 120, which is e.g. a microcomputer based device. The system controller 120 may receive inputs from operator input devices such as a joystick.

Pressurized hydraulic fluid is provided by at least one pump 32 driven by e.g. a motor which serves as the prime mover of the hydraulic system. The motor may be an engine in a mobile working machine or a separate motor, e.g. an electric motor.

The hydraulic system is incorporated in equipment, a boom crane or a mobile working machine that has movable members operated by hydraulically driven actuators, such as cylinders 24 and 26 with piston rods 24*a* and 26*a*. The first cylinder 24 is a double acting type in that pressurized fluid can be applied to either side of its piston rod 24*a*. The second cylinder 26 is a double acting type and pressurized fluid can be applied to either side of its piston rod 26*a*.

According to an example and the subsystem of FIG. 2, a first chamber 24*b* of the first cylinder 24 is the chamber supplying fluid under pressure and providing potential energy for recovery. The first chamber 24*b* is the bottom chamber of the cylinder 24. For the case shown in FIG. 1 the first cylinder 24 in FIG. 2 is used as the actuator 224 and controls the boom part 214. The first chamber 24*b* is driven by the flow of fluid from the pump 32 to raise a load.

According to an example and FIG. 2, potential energy is available from the first cylinder 24 with cylinder differential connection implemented e.g. with a valve 112 connecting and disconnecting the first and second chambers 24*b*, 24*c* of the first cylinder 24 or the lines leading to them. The valve 112 is e.g. an electrically controlled shut-off valve. When in an open state, the valve 112 leads hydraulic fluid from the piston side chamber of the first cylinder 24 (i.e. the first chamber 24*b*) to the piston rod side chamber of the first cylinder 24 (i.e. the second chamber 24*c*), or vice versa. Thus, the moving speed of the first cylinder 24 and its piston rod 24*a* increases.

According to another example of the presented solution, the first cylinder 24 in FIG. 2 is used as the actuator 226 of FIG. 1 connected between the boom parts 214 and 216 to control the boom part 216. In that example the second cylinder 26 of FIG. 3 controls the boom part 214 and the first chamber 26*b* of the second cylinder 26 is driven by the flow of fluid from the pump 32 to raise a load.

A directional control valve 28 controls the flow of hydraulic fluid into and out of the two chambers 24*b*, 24*c* within the cylinder 24. A directional control valve 30 controls the flow of hydraulic fluid into and out of the two chambers 26*b*, 26*c* within the cylinder 26. This type of valve is depicted schematically as an electrically controlled directional control valve having different states. In the presented system, fluid from the pump 32 is supplied via supply lines 46, 82 to the directional control valves 28 and 30. The supply lines may have branch supply lines leading hydraulic fluid to an appropriate component. The supply lines may be connected to a common supply line 105 receiving hydraulic fluid from the pump 32.

Tank lines 80, 104 lead hydraulic fluid from the directional control valves 28, 30 to a tank 34 receiving hydraulic fluid from the system. The system may comprise several tanks or several connections to a tank. The system may comprise separate tank lines for each directional control valve. The tank lines may include branch tank lines leading hydraulic fluid from an appropriate component. The tank lines may be connected to a common tank line 106 leading hydraulic fluid to the tank 34.

Figure 4:
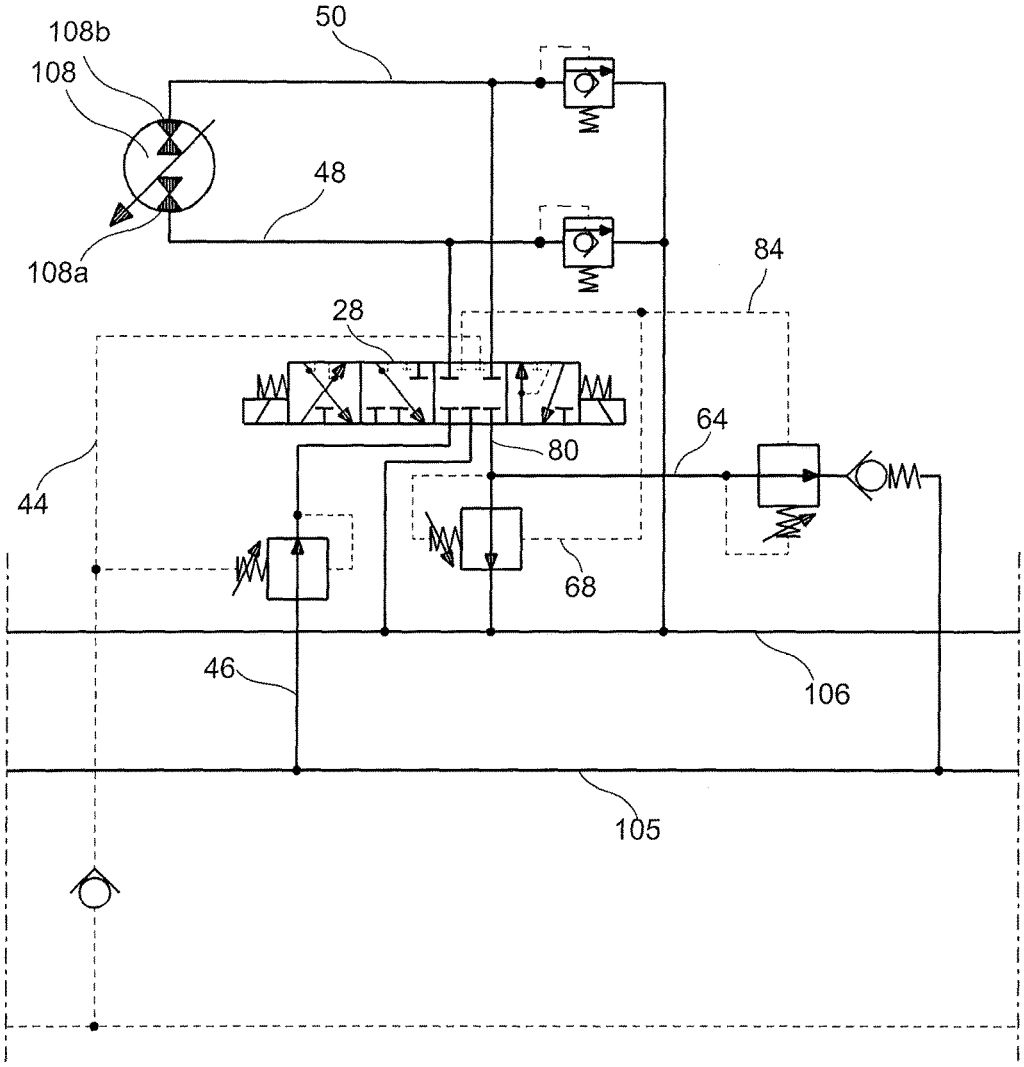
FIG. 4 shows a first alternative exemplary subsystem of the hydraulic system applying the presented solution and relating to FIG. 2.

According to an example and FIG. 2, the system may further comprise an additional tank line 107 for leading hydraulic fluid from the directional control valve 28 to the tank 34. The tank line 107 may be used to bypass components and lines connected to the tank line 80. The tank line 107 may be connected to the common tank line 106. In FIGS. 2 and 4 the tank line 107 is not necessary when the tank line 80 only is used for receiving hydraulic fluid from the directional control valve 28 and the directional control valve 28 is not equipped with a port or channeling for the tank line 107.

The directional control valves 28 and 30 are e.g. spool-type directional control valves which control flow of hydraulic fluid by moving a spool within a bore to selectively in different states connect different ports of the valve and thus different lines of the presented hydraulic system. The states of the directional control valves 28 and 30 are represented in the Figures as adjacent boxes showing the respective connections.

The first directional control valve 28 with its first state controls the flow of fluid from the supply line 46 to the first chamber 24*b* of the first cylinder 24 and the flow of fluid drained from the second chamber 24*c* of the first cylinder 24 to the tank line 80 or to the tank line 107 as shown in FIG. 2.

The first directional control valve 28 with its second state controls the flow of fluid drained from the first chamber 24*b* of the first cylinder 24 to the tank line 80. According to an example, the second chamber 24*c* of the first cylinder 24 is disconnected from the supply line 46 in the second state. According to an example, the second chamber 24*c* of the first cylinder 24, the supply line 46 and the tank line 107 are closed in the second state.

The first directional control valve 28 or the second directional control valve 30, or both of them, are proportional control valves operated electrically, hydraulically, mechanically or pneumatically. The directional control valves 28 and 30 are e.g. electrically operated valves with solenoid operation or proportional solenoid operation. The directional control valves 28 and 30 and their states are operated by electric signals from the system controller 120.

Additionally or as an alternative to the second state, the first directional control valve 28 may further have a third state in which it controls the flow of fluid from the supply line 46 to the second chamber 24*c* of the first cylinder 24 and the flow of fluid drained from the first chamber 24*b* of the cylinder 24 to the tank line 80. According to an example, the tank line 107 is closed in the third state.

The first directional control valve 28 may further have a closed state disconnecting or shutting the supply line 46, the second chamber 24*c* of the first cylinder 24, the first chamber 24*b* of first the cylinder 24 and the tank lines 80 and 170. Thus, the first directional control valve 28 may have at least one state disconnecting the tank line 80 and the recovery line 64 from the first actuator.

The first and third states of the first directional control valve 28 are used for moving the piston rod 24*a* in and out. The second state, and the third state, are in use when recovering hydraulic energy.

The second cylinder 26 comprises the first chamber 26*b* and the second chamber 26*c*. The second directional control valve 30 with its first state controls the flow of fluid from the supply line 82 to the first chamber 26*b* of the second cylinder 26 and the flow of fluid drained from the second chamber 26*c* of the second cylinder 26 to the tank line 104.

The second directional control valve 30 with its second state controls the flow of fluid drained from the first chamber 26*b* of the second cylinder 26 to the tank line 104. According to an example, the second chamber 26*c* of the second cylinder 26 is disconnected from the supply line 82 in the second state. According to an example, the second chamber 26*c* of the second cylinder 26 and the supply line 82 are closed in the second state.

Additionally or as an alternative to the second state, the second directional control valve 30 may further have a third state in which it controls the flow of fluid from the supply line 82 to the second chamber 26*c* of the second cylinder 26 and the flow of fluid drained from the first chamber 26*b* of the second cylinder 26 to the tank line 104.

The second directional control valve 30 may further have a closed state disconnecting or shutting the supply line 82, the second chamber 26*c* of the second cylinder 26, the first chamber 26*b* of the second cylinder 26 and the tank line 104. 9. Thus, the second directional control valve 30 may have at least one state disconnecting the recovery line 64 or the supply line 82 from the second actuator.

The first and second states of the second directional control valve 30 are used for moving the piston rod 26*a* in and out with or without the hydraulic fluid drained from the first cylinder 24.

According to an example and FIG. 2, the pump 32 is a load-sensing variable displacement pump for improving energy efficiency of the system and reducing energy losses. The pump 32 is configured to control its output flow of hydraulic fluid by matching the output flow with the load pressure sensed at the second cylinder 26. The pump 32 may further be configured to match the output flow with the load pressure sensed at the first cylinder 24.

According to another example the pump 32 is a fixed displacement pump with a 3-way pressure compensator valve.

The pump 32 senses the load pressure by using e.g. a load sensing line in communication with a line, a port or a point representing the load pressure of an actuator in e.g. a chamber of a hydraulic cylinder. The load sensing line is connected to a load control unit 42 of the pump 32.

The pump 32 has a load sensing line 60 in communication with the first chamber 26*b* of the second cylinder 26 when the second directional control valve 30 is in the first state. The load sensing line 60 may be in communication with the second chamber 26*c* of the second cylinder 26 when the second directional control valve 30 is in the third state.

According to another example, the load pressure may be sensed by a pressure sensor connected to the system controller 120 which controls the load control unit 42 or the pump 32. The pressure sensor is connected to a line, a port or a point representing the load pressure of an actuator in e.g. a chamber of a hydraulic cylinder.

The pump 32 may further have a load sensing line 44 in communication with the first chamber 24*b* of the first cylinder 24 when the first directional control valve 28 is in the first state. The load sensing line 44 may be in communication with the second chamber 24*c* of the first cylinder 24 when the first directional control valve 28 is in the third state.

According to the presented solution, the system comprises a recovery line 64 receiving fluid under pressure from the first directional control valve 28 via e.g. the tank line 80. The fluid under pressure is supplied from a first actuator represented by the first cylinder 24 and its first chamber 24*b* when the first directional control valve 28 is in the second state or in the third state. The recovery line 64 conveys fluid under pressure for driving a second actuator represented by the second cylinder 26 via the supply line 82. Fluid under pressure available in the recovery line 64 is supplied to the first chamber 26*b* of the second cylinder 26 when the second directional control valve 30 is in the first state.

Fluid under pressure available in the recovery line 64 may be supplied to the second chamber 26*c* of the second cylinder 26 when the second directional control valve 30 is in the third state.

The system comprises a check valve 74 which permits a flow of fluid from the recovery line 64 to the supply line 82, e.g. via the common supply line 105. The check valve 74 blocks the flow of fluid from the supply line 82, or the common supply line 105, to the recovery line 64. Blocking is used when the fluid pressure in the supply line 82 is higher than the fluid pressure in the recovery line 64 or the common supply line 105.

The system may further comprise a check valve 78 which permits a flow of fluid from the pump 32 to the supply line 82. The check valve 78 blocks the reverse flow of fluid from the supply line 82 to the pump 32. The check valve 78 is used to protect the pump 32 when the fluid pressure in the supply line 82 is higher than the fluid pressure of the hydraulic fluid delivered by the pump 32.

In the example of FIG. 2, the check valve 78 further permits a flow of fluid only from the pump 32 to the supply line 46 and the common supply line 105. The check valve 78 also blocks the flow of fluid back to the pump 32. An additional check valve in the supply line 46 instead of the check valve 78 may be used to permit a flow of fluid from the pump 32 only, or from the common supply line 105, to the supply line 46 and to block the flow of fluid in the reverse direction. Thus, the check valve 78 may be located elsewhere in the supply line 82 or the common supply line 105.

The presented system comprises a pressure compensating valve 66 for regulating the recovery of the hydraulic energy. The pressure compensating valve 66 controls the flow of fluid received from the first directional control valve 28 and being led to a tank, e.g. the tank 34. The first pressure compensating valve 66 is located in the tank line 80 or it is in communication with the tank line 80 and the tank or the common tank line 106.

The first directional control valve 28, the recovery line 64 and the pressure compensating valve 66 are connected in such a way that fluid under pressure from the first directional control valve 28 has a passage to both the pressure compensating valve 66 and the recovery line 64. According to an example and FIG. 2, the recovery line 64 is connected to the tank line 80 between the first directional control valve 28 and the pressure compensating valve 66.

The pressure compensating valve 66 is a pressure compensator used to maintain a preset pressure differential across a hydraulic component to minimize the influence of pressure variation on a flow rate passing through the component. In the example of FIG. 2, the component is the first directional control valve 28 in the second state or the third state. The pressure compensator has a controllable orifice and two fluid pressure sensing lines for controlling the controllable orifice. The controllable orifice is normally open when the pressure differential across a measuring orifice, i.e. the hydraulic component, is below a predetermined limit. The pressure compensating valve 66 is configured to have a setting defining the predetermined limit which the pressure differential across the controllable orifice should not exceed. The setting is implemented by e.g. an adjustable spring.

The pressure compensating valve 66 comprises two fluid pressure sensing lines 67 and 68. The first fluid pressure sensing line 67 is connected to a point in communication with the recovery line 64 and the fluid pressure in the recovery line 64. The second fluid pressure sensing line 68 is connected to a point in communication with the first actuator, i.e. the first chamber 24*b* of the first cylinder 24, when the first directional control valve 28 is in the second state or the third state.

When the fluid pressure in the first actuator, i.e. in the first chamber 24*b* of the first cylinder 24, rises to a level determined by the setting, the pressure compensating valve 66 starts controlling the flow of fluid from the first actuator or the first chamber 24*b*. Thus, the fluid pressure of the recovery line 64 rises and fluid under pressure is available for use. The fluid under pressure is used by the second actuator, i.e. the second cylinder 26.

Fluid under pressure available in both the recovery line 64 and the supply line 82, or the common supply line 105, is used for driving and controlling the second actuator when there is not enough fluid under pressure available solely from the recovery line 64.

According to an example and FIG. 2, the first directional control valve 28 is configured to connect the second pressure sensing line 68 with the first chamber 24*b* of the first cylinder 24. For example, the internal structure or a moving spool, or both of them, of the first directional control valve 28 comprises channels for connecting the second pressure sensing line 68 with the first actuator or the first chamber 24*b*, or, with a line 48 connecting the first actuator or the first chamber 24*b* and the first directional control valve 28.

The internal structure and the spool may further comprise channels for connecting the load sensing line 44 with the first actuator, the first chamber 24*b* or the line 48.

The second directional control valve 30 may be equipped with an internal structure or a moving spool, or both of them, with channels for connecting the load sensing line 60 with the second actuator or the first chamber 26*b* of the second cylinder 26, or, with a line 54 connecting the second actuator or the first chamber 26*b* and the second directional control valve 30 in the first state. The same principle relating to the internal structure or the moving spool applies to the second state of the second directional control valve 30 for connecting the load sensing line 60 with the second actuator or the second chamber 26*c* of the second cylinder 26, or, with a line 56 connecting the second actuator or the second chamber 26*c* and the second directional control valve 30.

The hydraulic system in FIGS. 2 and 3 utilizes the fluid under pressure being forced from the first chamber 24*b* of the first cylinder 24 to be available in the recovery line 64 for driving the second actuator or the second cylinder 26 when the first directional control valve 28 is in the second state or in the third state. The fluid pressure in the recovery line 64 is dependent on the fluid pressure in the first chamber 24*b*, and the pressure compensating valve 66 controls the fluid flow in the recovery line 64.

In a case when the fluid pressure needed for driving the second actuator or the second cylinder 26 is lower than the fluid pressure available in the recovery line 64, and the second directional control valve 30 is in the first or second state, then fluid under pressure from the first chamber 24*b* of the first cylinder 24 will flow to the second actuator or a chamber of the second cylinder 26 via the recovery line 64. The port of the second actuator or the chamber of the second cylinder 26 receiving the fluid under pressure will be determined by the selected state of the second directional control valve 30.

Therefore, potential energy produced in the first actuator or the first chamber 24*b* of the first cylinder 24 may be used in the second actuator. Fluid under pressure is available in the recovery line 64 independently of the state of the second directional control valve 30. Thus, energy is saved when the first directional control valve 28 is in the second state, or in the third state, and there is no need to supply fluid under pressure from the pump 32 to the first actuator or the first cylinder 24. Energy is saved even in a case where supplementing fluid under pressure is led to the first actuator or the second chamber 24*c* of the first cylinder 24 from the pump 32 in the third state of the first directional control valve 28.

Additional energy is saved in at least the first state or the second state of the second directional control valve 30 when the second actuator or the second cylinder 26 can be supplied with fluid under pressure from the first actuator or the first cylinder 24 only or partially supplemented with fluid under pressure from the pump 32 in the third state of the second directional control valve 30.

The fluid under pressure that is not used will be directed to the tank 34 or the common tank line 106 via the pressure compensating valve 66. Additionally, in the third state of the first directional control valve 28, when driving the first actuator or the second chamber 24*c* of the first cylinder 24 with fluid under pressure from the pump 32, additional potential energy produced in the first actuator or the first chamber 24*b* of the first cylinder 24 may be used in the second actuator.

For good controllability of the first actuator, the first cylinder 24 or the flows of fluid in the system, the system may be provided with a second pressure compensating valve 70 in the recovery line 64. The second pressure compensating valve 70 controls the flow of fluid from the recovery line 64 to the supply line 82 or the common supply line 105 via the second check valve 74. The second pressure compensating valve 70 is a pressure compensator and has two fluid pressure sensing lines 72 and 84.

The first pressure sensing line 72 is connected to a point in communication with the recovery line 64 and the fluid pressure in recovery line 64. The second pressure sensing line 84 is connected to a point in communication with the first actuator, i.e. the first chamber 24*b* of the first cylinder 24, when the first directional control valve 28 is in the second state or the third state.

According to an example and FIG. 2, the first directional control valve 28 is configured to connect the second pressure sensing line 84 and the first actuator or the first chamber 24*b* of the first cylinder 24. For example, the internal structure or a moving spool of the first directional control valve 28 comprises channels for making necessary connections. Alternatively, the second pressure sensing line 84 of the second pressure compensating valve 70 is connected to the second pressure sensing line 68 of the first pressure compensating valve 66.

The second pressure compensating valve 70 is a pressure compensator used for maintaining a preset pressure differential across the first directional control valve 28 in the second state or the third state. The second pressure compensating valve 70 is configured to have a setting defining a predetermined limit preferably higher than the predetermined limit of the first pressure compensating valve 66. The setting is implemented with e.g. an adjustable spring. Fluid under pressure is available in the recovery line 64 for driving the second actuator or the second cylinder 26.

The system may further have in the supply line 46 a third pressure compensating valve 86 for the first directional control valve 28 for improved pressure control of the first actuator or the first cylinder 24. The third pressure compensating valve 86 has a first pressure sensing line 87 in communication with or connected to the supply line 46 and a second pressure sensing line 85 in communication with the first actuator or the first chamber 24*b* of the first cylinder 24 when the first directional control valve 28 is in the first state, or, with the first actuator or the second chamber 24*c* of the first cylinder 24 when the first directional control valve 28 is in the third state. Alternatively, the second pressure sensing line 85 is connected to the first load sensing line 44 of the pump 32.

The system may further comprise, in the supply line 82, a fourth pressure compensating valve 88 for the second directional control valve 30 for improved pressure control of the second actuator or the second cylinder 26. The fourth pressure compensating valve 88 has a first pressure sensing line 89 in communication with or connected to the supply line 82 and a second pressure sensing line 94 in communication with the second actuator or the first chamber 26*b* of the second cylinder 26 when the second directional control valve 30 is in the first state, or, with the second actuator or the second chamber 26*c* of the second cylinder 26 when the second directional control valve 30 is in the second or third state. Alternatively, the second pressure sensing line 94 is connected to the second load sensing line 60 of the pump 32.

The system may further have a first anti-cavitation check valve 38 for allowing a flow of fluid from the tank line 104 or the common tank line 106 to the first actuator or the second chamber 24*c* of the first cylinder 24. The anti-cavitation check valve 38 is used when the first directional control valve 28 is in the second state. The system may have a line 50 connecting the first directional control valve 28 and the first actuator or the second chamber 24*c* of the first cylinder 24. In an example, the first anti-cavitation check valve 38 is located in a line 52 connecting the tank line 104 or the common tank line 106 to the line 50. Thus, the anti-cavitation check valve 38 connects the first actuator to a tank line, e.g. the tank line 106, for receiving substitute fluid from the tank line.

Additionally, the system may comprise a second anti-cavitation check valve 90 for allowing a flow of fluid from the tank line 104, the common tank line 106, or the line 52 to the first actuator, the first chamber 24*b* of the first cylinder 24 or the line 48.

The system may comprise a check valve 76 allowing a flow of fluid to the tank 34 from the common tank line 106 or the tank lines 80 and 104. According to an example and FIG. 2, the check valve 76 is located between the tank 34 and the pressure compensating valve 66. The check valve 76 guarantees an adequate fluid pressure at the anti-cavitation check valves for avoiding cavitation.

The system may further comprise a third anti-cavitation check valve 40 for allowing a flow of fluid from the tank line 104 or the common tank line 106 to the second actuator or the second chamber 26*c* of the second cylinder 26. The third anti-cavitation check valve 40 is used e.g. when the second directional control valve 30 is in the second state or the fluid pressure of the second actuator decreases below the fluid pressure of the tank line 104.

The system may have the line 56 connecting the second directional control valve 30 and the second actuator or the second chamber 26*c* of the second cylinder 26. In an example and FIG. 3, the third anti-cavitation check valve 40 is located in a line 58 connecting the tank line 104 or the common tank line 106 to the line 56.

Additionally, the system may comprise a fourth anti-cavitation check valve 92 for allowing a flow of fluid from the tank line 104 or the common tank line 106 to the second actuator, the first chamber 26*b* of the second cylinder 26 or the line 54.

The foregoing description was primarily directed to example embodiments of the presented solution. The presented solution is also used in apparatuses and systems other than a boom crane. The presented system may comprise additional cylinders or actuators driven by the hydraulic fluid supplied by the pump of the system. The additional cylinders or actuators are connected to e.g. the supply lines, the common supply line 105, the tank lines and the common tank line 106 in the same manner as in FIG. 3. The presented system may comprise two or more subsystems as shown in FIG. 2 and providing energy recovery. The presented system may comprise additional cylinders or actuators providing fluid under pressure as shown in FIG. 2.

In an alternative example, one or both cylinders 24, 26 are installed upside down compared to FIG. 1. Thus, in the system of FIG. 2, the second chamber 24*c* and the first chamber 24*b* switch places and potential energy is generated in the second chamber 24*c*. The second chamber 24*c* is the piston rod side chamber of the first cylinder 24. The directional control valves of the system in FIG. 2 may further have additional functionalities and states.

One or more of the anti-cavitation check valves 38, 40, 90 and 92 may have further functionality or are integrated in a pressure reducing valve or a safety valve as shown in FIG. 2.

In FIG. 4, the presented solution is further represented by a second exemplary hydraulic system in which the first cylinder 24 shown in FIG. 2 is replaced with an actuator which is a pump-motor 108 having two ports 108*a* and 108*b*. The pump-motor assembly is a combination of a motor and a pump. The pump-motor 108 has two directions of flow. One direction of flow may be used to raise a load connected to the pump-motor 108 and the opposite direction of flow of fluid under pressure is generated by e.g. a lowering load. The pump-motor 108 may be of variable displacement type or fixed displacement type. The recovered energy in the form of pressurized fluid supplied by the port 108*a* is used to drive another simultaneous actuator function, e.g. the second actuator or the second cylinder 26 shown in FIG. 3.

The port 108*b* of the pump-motor 108 is connected in a manner similar to the second chamber 24*c* of the first cylinder 24, and the port 108*a* of the pump-motor 108 is connected in a manner similar to the first chamber 24*b* of the first cylinder 24. The functionality, principles and details already explained and relating to the components of the subsystem shown in FIG. 2 apply to the subsystem of FIG. 4 showing similar components.

Figure 5:
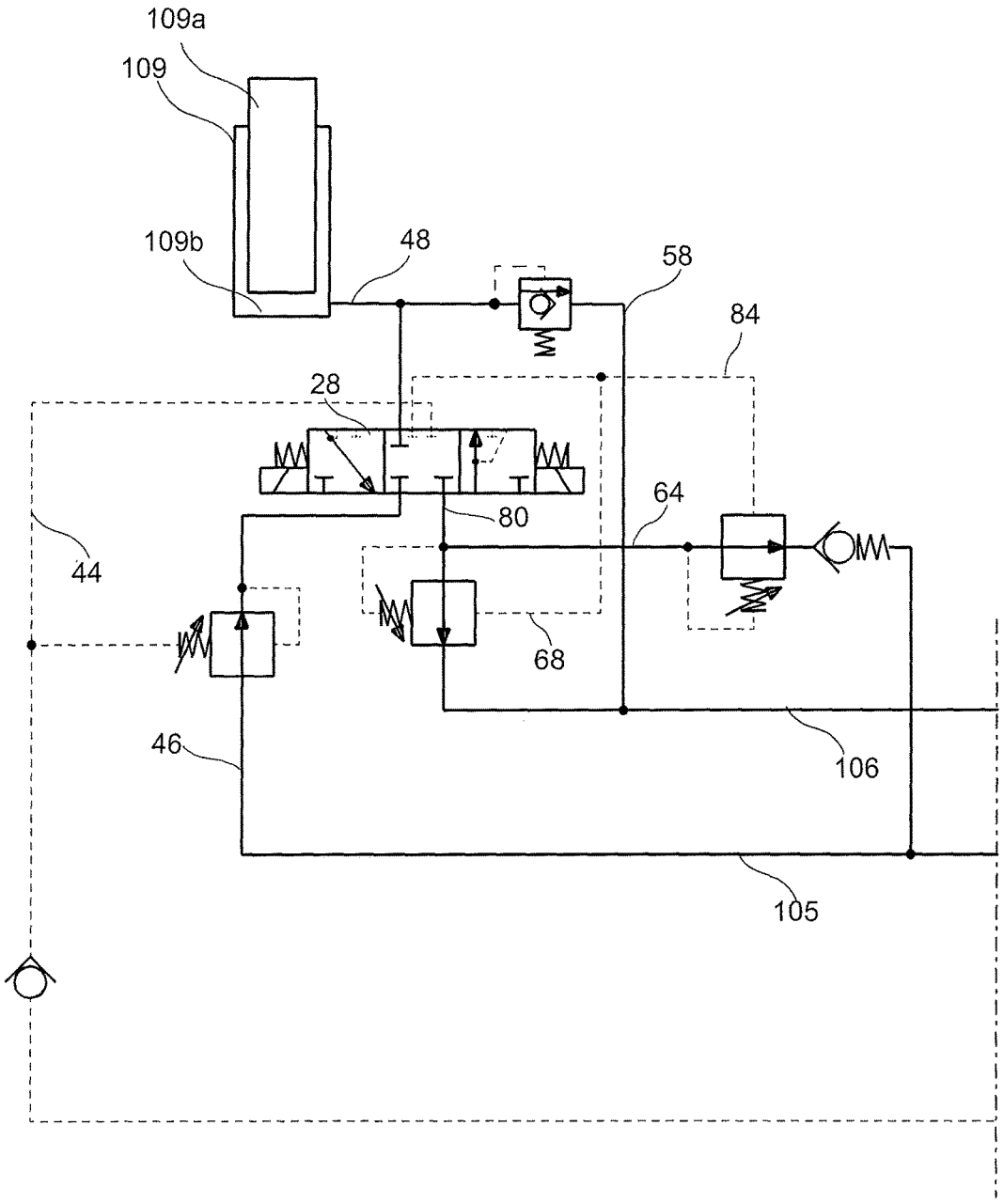
FIG. 5 shows a second alternative exemplary subsystem of the hydraulic system applying the presented solution and relating to FIG. 2.

In FIG. 5, the presented solution is further represented by a third exemplary hydraulic system in which the first cylinder 24 shown in FIG. 2 is replaced with an actuator which is a hydraulic cylinder 109. The cylinder 109 is of a single acting type in that pressurized fluid can be supplied to a chamber 109*b* on one side of its piston rod 109*a* only. The chamber 109*b* is driven by the flow of fluid from e.g. the pump 32 to e.g. raise a load. For example, a lowering load generates potential energy in the chamber 109*b*. The recovered energy in the form of pressurized fluid from the chamber 109*b* is used to drive another simultaneous actuator function, e.g. the second actuator or the second cylinder 26 shown in FIG. 3.

The chamber 109*b* of the cylinder 109 is connected in a manner similar to the first chamber 24*b* of the first cylinder 24. The functionality, principles and details already explained and relating to the components of the subsystem shown in FIG. 2 apply to the subsystem of FIG. 5 showing similar components. The line 50 and the anti-cavitation check valve 38 of FIG. 2 are not necessary in the subsystem of FIG. 5. The tank line 107 of FIG. 2 is not necessary but may be included in the system of FIG. 5 and the first directional control valve 28 of FIG. 5 may equipped correspondingly, e.g. with an additional port similar to FIG. 2. The first directional control valve 28 may have a simplified configuration as shown in FIG. 5 when used with the cylinder 109. The directional control valve 28 controls the flow of hydraulic fluid into and out of the chamber 109*b*. The directional control valve 28 of FIG. 5 may have less ports than in FIG. 2.

In FIG. 5, the first directional control valve 28 with its first state controls the flow of fluid from the supply line 46 to the chamber 109*b* and with its second state controls the flow of fluid drained from the chamber 109*b* to the tank line 80. According to an example, in the second state the supply line 46 is closed or in the first state the tank line 80 is closed. The first directional control valve 28 may further have a closed state disconnecting or shutting the supply line 46, the chamber 109*b* and the tank line 80. The first state of the first directional control valve 28 is used for moving the piston rod 109*a* out. The second state is in use when recovering hydraulic energy.

In FIG. 5, the pressure sensing line 68, and the pressure sensing line 84, are connected to a point in communication with the chamber 109*b* when the first directional control valve 28 is in the second state. According to an example and FIG. 5, the first directional control valve 28 is configured to connect the second pressure sensing line 68 and the chamber 109*b* by means of the internal structure or the moving spool of the first directional control valve 28. The load sensing line 44 is in communication with the chamber 109*b* when the first directional control valve 28 is in the first state.

Figure 6:
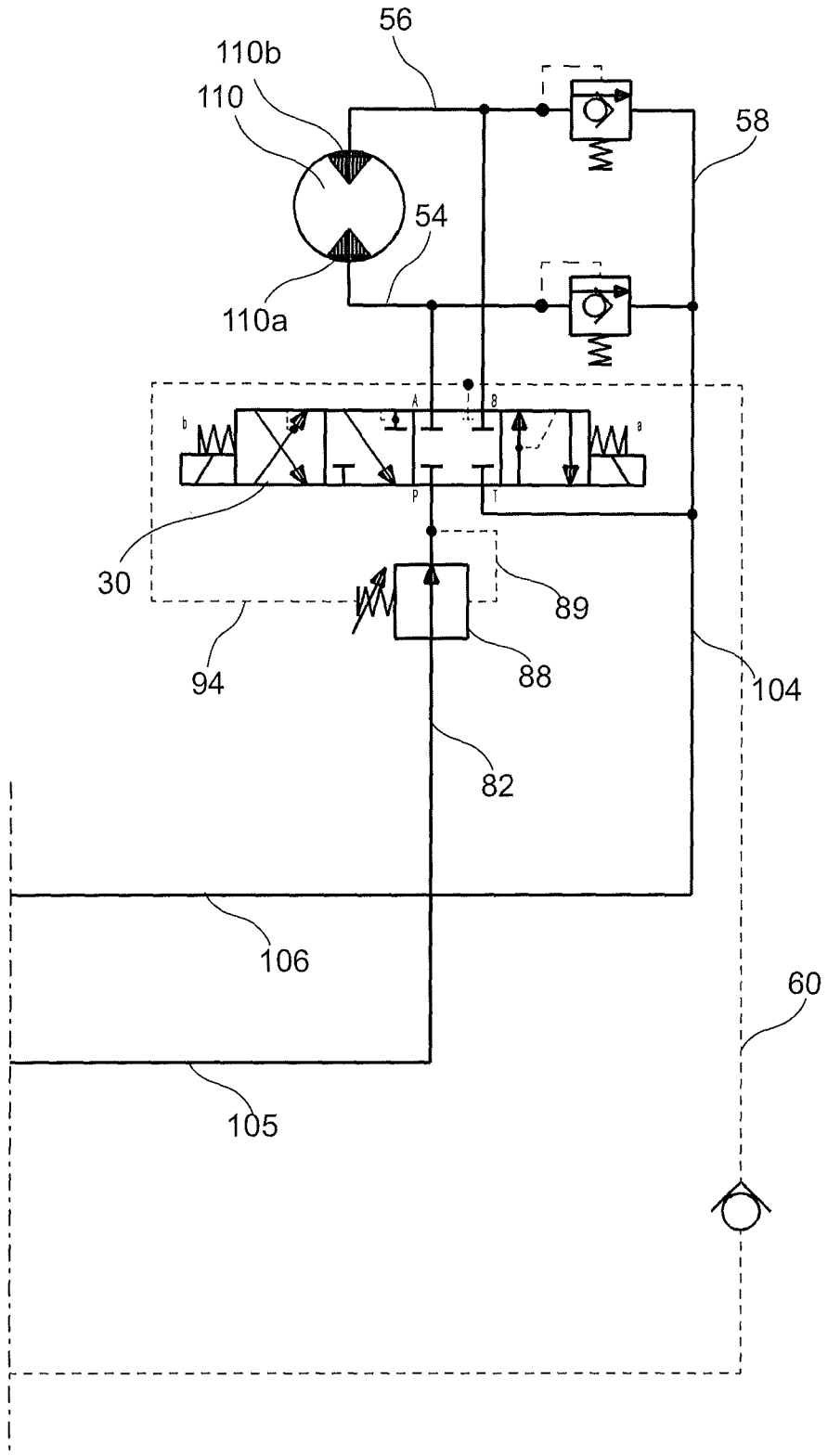
FIG. 6 shows a third alternative exemplary subsystem of the hydraulic system applying the presented solution and relating to FIG. 3.

In FIG. 6, the presented solution is further represented by a fourth exemplary hydraulic system in which the second cylinder 26 shown in FIG. 3 is replaced with an actuator which is a motor 110 having two ports 110*a* and 110*b*. The motor 110 is of the fixed displacement type, or the variable displacement type, with two directions of flow.

The port 110*b* of the motor 110 is connected in a manner similar to the second chamber 26*c* of the second cylinder 26 and the port 110*a* of the motor 110 is connected in a manner similar to the first chamber 26*b* of the second cylinder 26. The functionality, principles and details already explained and relating to the components of the subsystem shown in FIG. 3 apply to the subsystem of FIG. 6 showing similar components.

Fluid under pressure available in the recovery line 64 or in the supply line 82, or both, is used for driving and controlling the motor 110.

Figure 7:
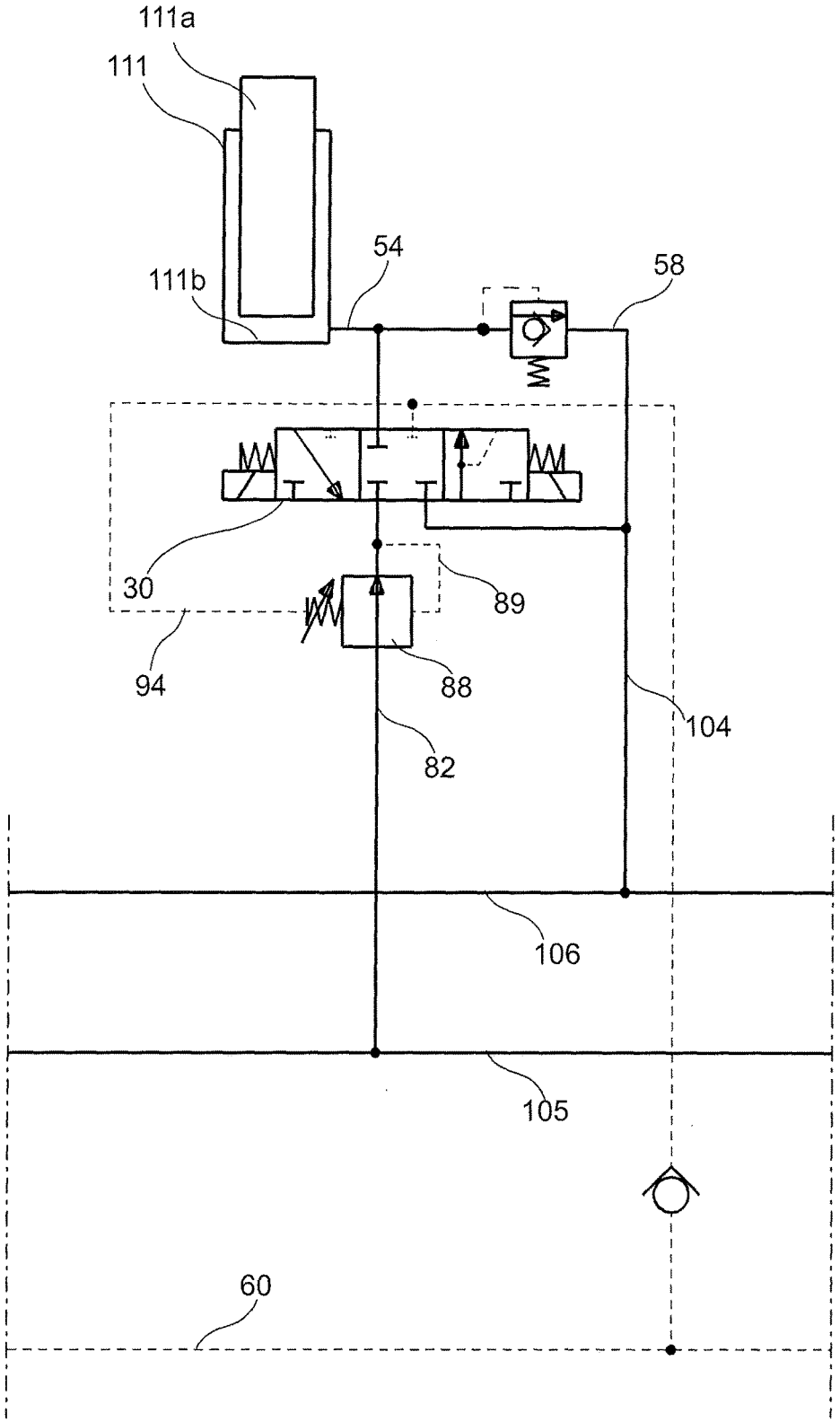
FIG. 7 shows a fourth alternative exemplary subsystem of the hydraulic system applying the presented solution and relating to FIG. 3.

In FIG. 7, the presented solution is further represented by a fifth exemplary hydraulic system in which the cylinder 26 shown in FIG. 3 is replaced with an actuator which is a hydraulic cylinder 111. The cylinder 111 is of the single acting type in that pressurized fluid can be supplied to a chamber 111*b* on one side of its piston rod 111*a* only. The chamber 111*b* is driven by fluid under pressure available in the recovery line 64 or in the supply line 82, or both.

The chamber 111*b* is connected in a manner similar to the first chamber 26*b* of the second cylinder 26. The functionality, principles and details already explained and relating to the components of the subsystem shown in FIG. 3 apply to the subsystem of FIG. 7 showing similar components. The line 56 and the anti-cavitation check valve 40 of FIG. 3 are not necessary in the subsystem of FIG. 7. The second directional control valve 30 may have a simplified configuration when used with the cylinder 111. The directional control valve 30 controls the flow of hydraulic fluid into and out of the chamber 111*b*. The directional control valve 30 of FIG. 7 may have less ports than in FIG. 3.

In FIG. 7, the second directional control valve 30 with its first state controls the flow of fluid from the supply line 82 to the chamber 111*b*, and with its second state controls the flow of fluid drained from the chamber 111*b* to the tank line 104. According to an example, in the second state the supply line 82 is closed or in the first state the tank 104 line is closed. The second directional control valve 30 may further have a closed state disconnecting or shutting the supply line 82, the chamber 111*b* and the tank line 104. The first state of the second directional control valve 30 is used for moving the piston rod 111*a* out.

In FIG. 7, the load sensing line 60 is connected to a point in communication with the chamber 111*b* when the second directional control valve 30 is in the first state. According to an example and FIG. 7, the second directional control valve 30 is configured to connect the load sensing line 60 and the chamber 111*b* by means of the internal structure or the moving spool of the second directional control valve 30.

According to further exemplary hydraulic systems of the presented solution, the subsystem of FIG. 2 may be replaced with one or both of the subsystems in FIGS. 4 and 5. In addition to the subsystem of FIG. 2, the presented system may have one or both of the subsystems of FIGS. 4 and 5. According to further exemplary hydraulic systems of the presented solution, the subsystem of FIG. 3 may be replaced with one or both of the subsystems in FIGS. 6 and 7. In addition to the subsystem of FIG. 3, the presented system may have one or both of the subsystems in FIGS. 6 and 7.

Other components necessary for the basic functioning of the presented hydraulic circuit and controlling flows of fluid in the presented system may be added to the solution presented in the Figures.

The solution is not limited solely to the above-presented embodiments, but it can be modified within the scope of the appended claims.

The invention claimed is:

1. A hydraulic system for recovering hydraulic energy, the hydraulic system comprising at least:

a first actuator for generating hydraulic energy and providing fluid under pressure, a tank line for receiving the fluid under pressure drained from the first actuator, a second actuator driven by the fluid under pressure drained from the first actuator, a recovery line for supplying the fluid under pressure drained from the first actuator to the second actuator for driving the second actuator, wherein the fluid pressure in the recovery line is dependent on the fluid pressure in the first actuator, a first directional control valve having at least one state in which the first actuator is in communication with the tank line and the recovery line, wherein the tank line and the recovery line receive the fluid under pressure from the first actuator via the first directional control valve, a second directional control valve having at least one state in which the second actuator is in communication with the recovery line, wherein the second actuator receives the fluid under pressure from the recovery line via the second directional control valve, a pressure compensating valve which controls flow of fluid in the tank line and maintains a fluid pressure differential across the first directional control valve when the first directional control valve is in the state connecting the first actuator, the tank line and the recovery line, which fluid pressure differential is dependent on a setting of the first pressure compensating valve, wherein the first pressure compensating valve is provided with a first fluid pressure sensing line in communication with the recovery line, and a second fluid pressure sensing line in communication with the first actuator when the first directional control valve is in the state connecting the first actuator, the tank line and the recovery line.

2. The system according to claim 1, wherein the first actuator is a double acting hydraulic cylinder, a single acting hydraulic cylinder or a hydraulic pump-motor, and wherein the second actuator is a double acting hydraulic cylinder, a single acting hydraulic cylinder or a hydraulic motor.

3. The system according to claim 1, wherein the system comprises several actuators generating hydraulic energy and providing fluid under pressure for driving one or more other actuators, or, the system comprises several actuators driven by fluid under pressure drained from one or more actuators generating hydraulic energy and providing fluid under pressure.

4. The system according to claim 1, wherein the hydraulic system further comprises a check valve in the recovery line for blocking flow of fluid from the second actuator to the recovery line.

5. The system according to claim 1, wherein the system further comprises:

a supply line for supplying fluid under pressure to the first actuator to drive the first actuator, and another tank line for receiving fluid drained from the first actuator, wherein the first directional control valve further has a state connecting the supply line and the other tank line to the first actuator.

6. The system according to claim 5, wherein the second fluid pressure sensing line of the pressure compensating valve is disconnected from the first actuator when the first directional control valve is in the state connecting the first actuator, the supply line and the other tank line.

7. The system according to claim 1, wherein the system further comprises a supply line for supplying fluid under pressure to the second actuator, wherein the second directional control valve further has at least one state in which the second actuator is in communication with the recovery line and the supply line such that fluid under pressure is available both in the recovery line and the supply line for driving the second actuator.

8. The system according to claim 1, wherein the first directional control valve is configured to connect the second pressure sensing line of the pressure compensating valve with the first actuator.

9. The system according to claim 1, wherein the system further comprises:

a tank line for receiving fluid drained from the second actuator, wherein the second directional control valve further has at least one state connecting the tank line to the second actuator.

10. The system according to claim 1, wherein the system further comprises:

a second pressure compensating valve which controls the flow of fluid in the recovery line and maintains a fluid pressure differential across the first directional control valve when the first directional control valve is in the state connecting the first actuator, the tank line and the recovery line, which fluid pressure differential is dependent on a setting of the second pressure compensating valve, wherein the second pressure compensating valve is provided with a first pressure sensing line in communication with the recovery line, and a second pressure sensing line in communication with the first actuator when the first directional control valve is in the state connecting the first actuator, the tank line and the recovery line.

11. The system according to claim 10, wherein the first directional control valve is configured to connect the second pressure sensing line of the second pressure compensating valve with the first actuator, or, the second pressure sensing line of the second pressure compensating valve is connected to the second pressure sensing line of the first pressure compensating valve.

12. The system according to claim 1, wherein the recovery line is connected to the tank line at a point located between the first directional control valve and the pressure compensating valve.

13. The system according to claim 1, wherein the system further comprises a pump supplying fluid under pressure to a supply line, wherein the pump is of the load-sensing type and has a first load sensing line in communication with the first actuator when the first directional control valve is in the state connecting the first actuator, the tank line and the recovery line.

14. The system according to claim 13, wherein the first directional control valve is configured to connect the first load sensing line with the first actuator.

15. The system according to claim 13, wherein the pump is further provided with a second load sensing line in communication with the second actuator when the second directional control valve is in the state connecting the second actuator and the recovery line or the supply line.

16. The system according to claim 1, wherein the system further comprises a pressure compensating valve which controls the flow of fluid supplied to the first directional control valve, which pressure compensating valve is provided with a first pressure sensing line in communication with the flow of fluid supplied to the first directional control valve, and a second pressure sensing line in communication with the first actuator when the first directional control valve is in the state connecting the first actuator, the tank line and the recovery line.

17. The system according claim 1, wherein the system further comprises a pressure compensating valve which controls the flow of fluid supplied to the second directional control valve, which pressure compensating valve is provided with a first pressure sensing line in communication with the flow of fluid supplied to the second directional control valve, and a second pressure sensing line in communication with the second actuator when the second directional control valve is in the state connecting the recovery line, or the supply line, and the second actuator.

18. The system according to claim 1, wherein the system further comprises a valve for cylinder differential connection, which valve has a state leading hydraulic fluid between a piston side chamber of the first actuator and a piston rod side chamber of the first actuator.

19. The system according to claim 14, wherein the pump is further provided with a second load sensing line in communication with the second actuator when the second directional control valve is in the state connecting the second actuator and the recovery line or the supply line.

* * * * *